US005241796A

United States Patent [19]

Hellwig et al.

[11] Patent Number: 5,241,796

[45] Date of Patent: Sep. 7, 1993

[54] SECURING BRACKET

[75] Inventors: John Hellwig, Toronto; Lorie Marangoni, Weston, both of Canada

[73] Assignee: Teknion Furniture Systems, Downsview, Canada

[21] Appl. No.: 878,219

[22] Filed: May 4, 1992

[51] Int. Cl.[5] ..... E04B 2/74; A47B 57/26

[52] U.S. Cl. ..... 52/36.4; 52/239; 52/285.1; 211/94.5; 211/162; 248/225.1

[58] Field of Search ..... 52/36, 239, 280, 285, 52/270, 271, 238.1, 35, 285.1, 285.2, 285.3, 285.4; 211/94, 94.5, 162; 160/135; 248/222.1, 222.3, 225.1; 403/294, 295, 297; 362/147, 145, 133, 132

[56] References Cited

U.S. PATENT DOCUMENTS

| | | | |
|---|---|---|---|
| 3,891,172 | 6/1975 | Einhorn | 248/222.1 |
| 4,598,504 | 7/1986 | Itagaki | 52/36 |
| 4,635,801 | 1/1987 | Oren | 211/94 |
| 4,805,784 | 2/1989 | Solheim et al. | 211/94 |

*Primary Examiner*—Michael Safavi

[57] ABSTRACT

A securing arrangement for office panels accommodates off panel angular connection while structural securement of the panels is obtained. The panels have accessible rails at predetermined heights which can be engaged by a structural member which in turn locks with an adjacent panel. Preferably, several structural members are used for securing two adjacent panels.

13 Claims, 3 Drawing Sheets

SECURING BRACKET

FIELD OF THE INVENTION

The present invention relates to office panelling systems and, in particular, relates to methods of interconnecting office panels.

BACKGROUND OF THE INVENTION

Office panelling systems typically are designed about individual office panels which can be interconnected and joined to subdivide what would otherwise be an open space. Initially, individual free-standing panels were used, however, integrated panelling systems now also serve as passageways for conduits, for power and communications wiring, as well as for supporting office components such as desks, filing cabinets, etc. The interconnected panelling systems typically rely on the series of connected panels for stability. 'T' junctions of panels typically occur at a junction of panel ends and various connections methods have been proposed at such a junction. A junction intermediate a panel length is difficult to interconnect and causes problems with passage of wires between panels. Although a 'T' shaped junction is the most typical, other angled junctions are used.

Panelling systems are designed to allow for both flexibility in initial design as well as flexibility in changing the design should the needs of the space change in the future.

There remains a need for a panelling system having improved flexibility.

SUMMARY OF THE INVENTION

A securing arrangement for engaging the frame of an office panel, according to the present invention, comprises a first engaging member for receipt in a slot and a movable cam member for movement from a position accommodating placement of said first engaging member in said slot to a position cooperating with said slot to fixedly locate said first engaging member relative to said slot. This securing arrangement can engage slots provided in the panels and can quickly secure the panels together at a host of locations intermediate a panel length as opposed to connections at the ends of the panels. Therefore, a junction between two panels can occur intermediate the length of one of the panels while still providing positive securement of the panels to one another. Preferably, panels are connected at two different height positions and the first member has a downwardly engaging flange received in the slot.

The invention is also directed to an office panelling system having a multiplicity of interconnected panels joined in end-to-end fashion with other panels joined at an angle to the first series of panels. The panels each have cover members supported by interior frames, with each frame having horizontal securing rails at common specified locations from the base of each panel and running horizontally across the frame. The panels, at a junction, are positively secured with one end of the panels intermediate the length of, and at an angle to, another one of said panels, with the securement being accomplished by means of a securing arrangement. The securing arrangement engages corresponding rails of each panel and fixedly secures the panels in a predetermined orientation due to the rigid connection therebetween.

According to a further aspect of the invention, this securing arrangement fixedly secures said panels at predetermined angular orientations.

According to yet a further aspect of the invention, the securing arrangement is a fixed bracket having opposite end flanges engaged in respective slots of the joined panels.

According to yet a further aspect of the invention, the rails are located at spaced intervals between the base and top of the panels.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
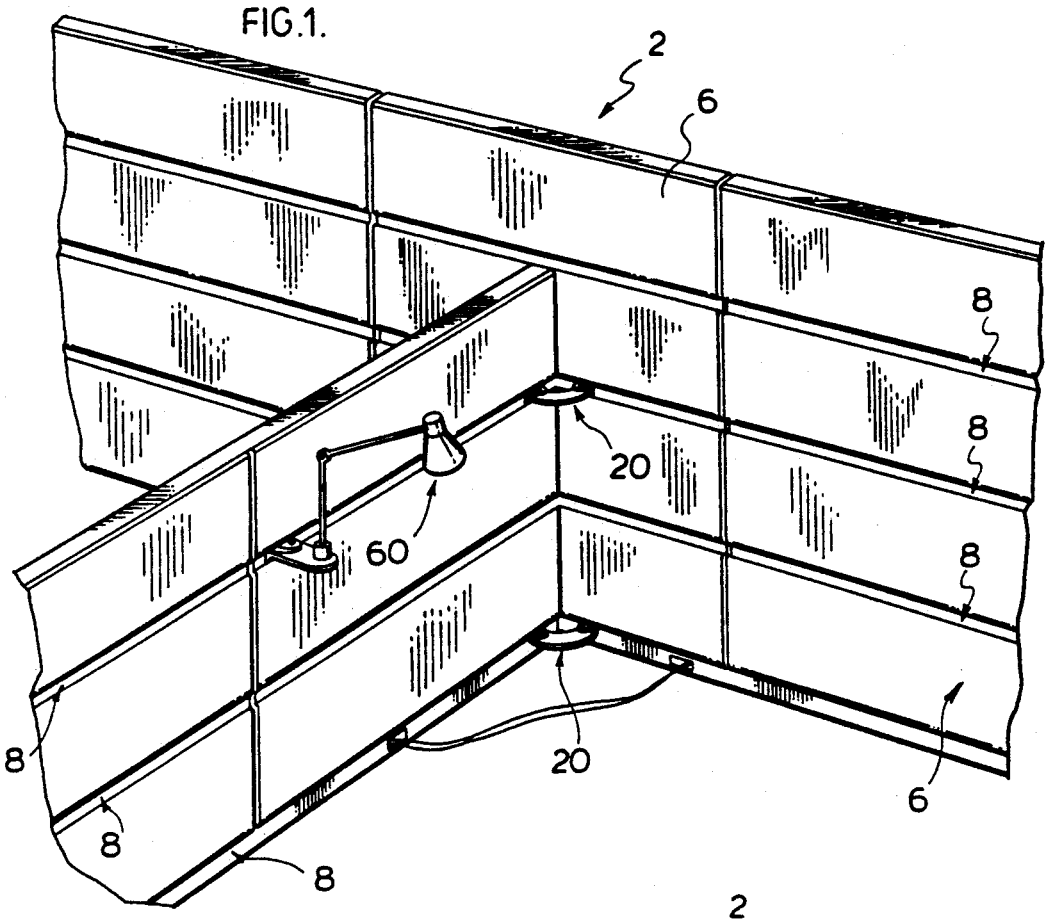
FIG. 1 is a partial perspective view showing two series of panels interconnected, with one series intermediate the length of, and secured to, one of the panels of the other series.
Figure 2:
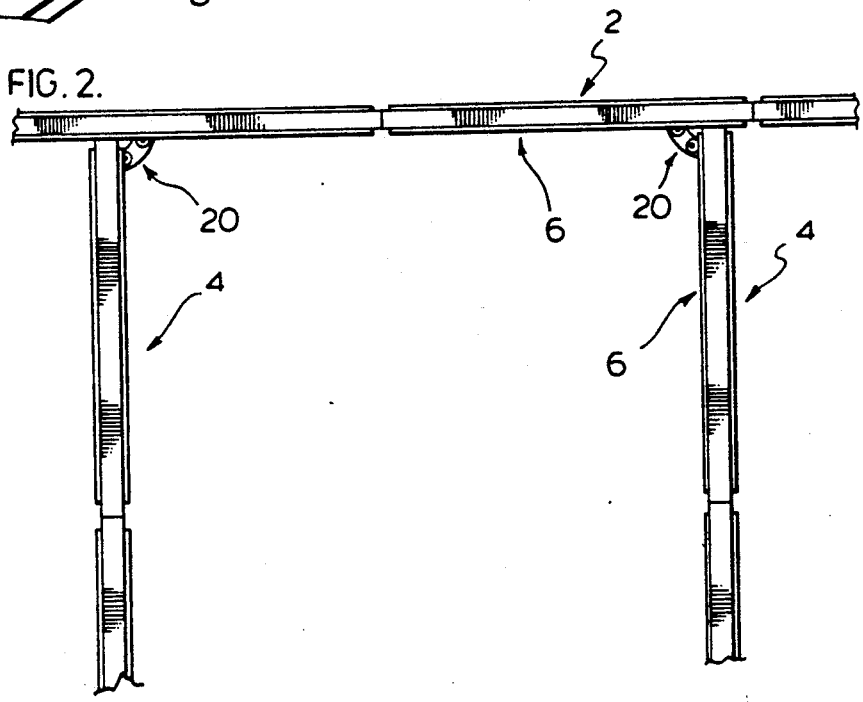
FIG. 2 is a partial top view showing various series of panels interconnected intermediate the length of individual panels.

A first series of office panels 2 are shown in FIG. 1 with a second series of office panels indicated as 4. The second series forms a generally perpendicular junction with the first series of connected office panels 2. Securing brackets 20 are shown in FIG. 1 maintaining the particular desired orientation of the connected first series of office panels 2 and the connected second series of office panels 4. The series of connected office panels are each made up of individual office panels 6. Each office panel 6 has a number of horizontal slots shown as 8 which are visible and actually form part of the frame that is behind the decorative elements 12. Thus, the office panels include an interior metal frame 10 which has a number of horizontal slots 8 which are exposed between the horizontal junction between vertically spaced decorative elements 12. The interior metal frame 10 secures and supports the decorative elements 12.

The first horizontal slot 8 is provided approximately 6 inches above the base of a panel and then preferably is provided at 15 inch intervals. The panel frame includes all of the slots 8 however decorative elements can fully conceal these slots.

Figure 3:
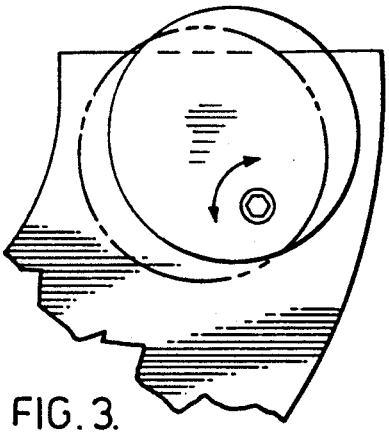
FIG. 3 is a partial top view showing movement of a camming member used to lock the securing bracket.
Figure 4:
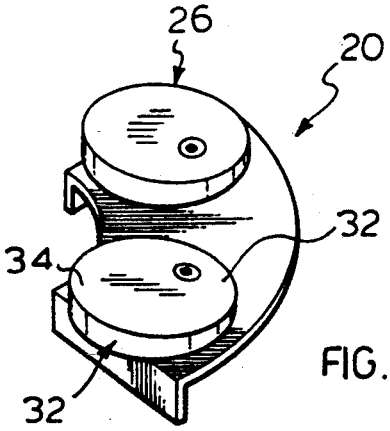
FIG. 4 is a perspective view of the securing bracket with two camming members.
Figure 5:
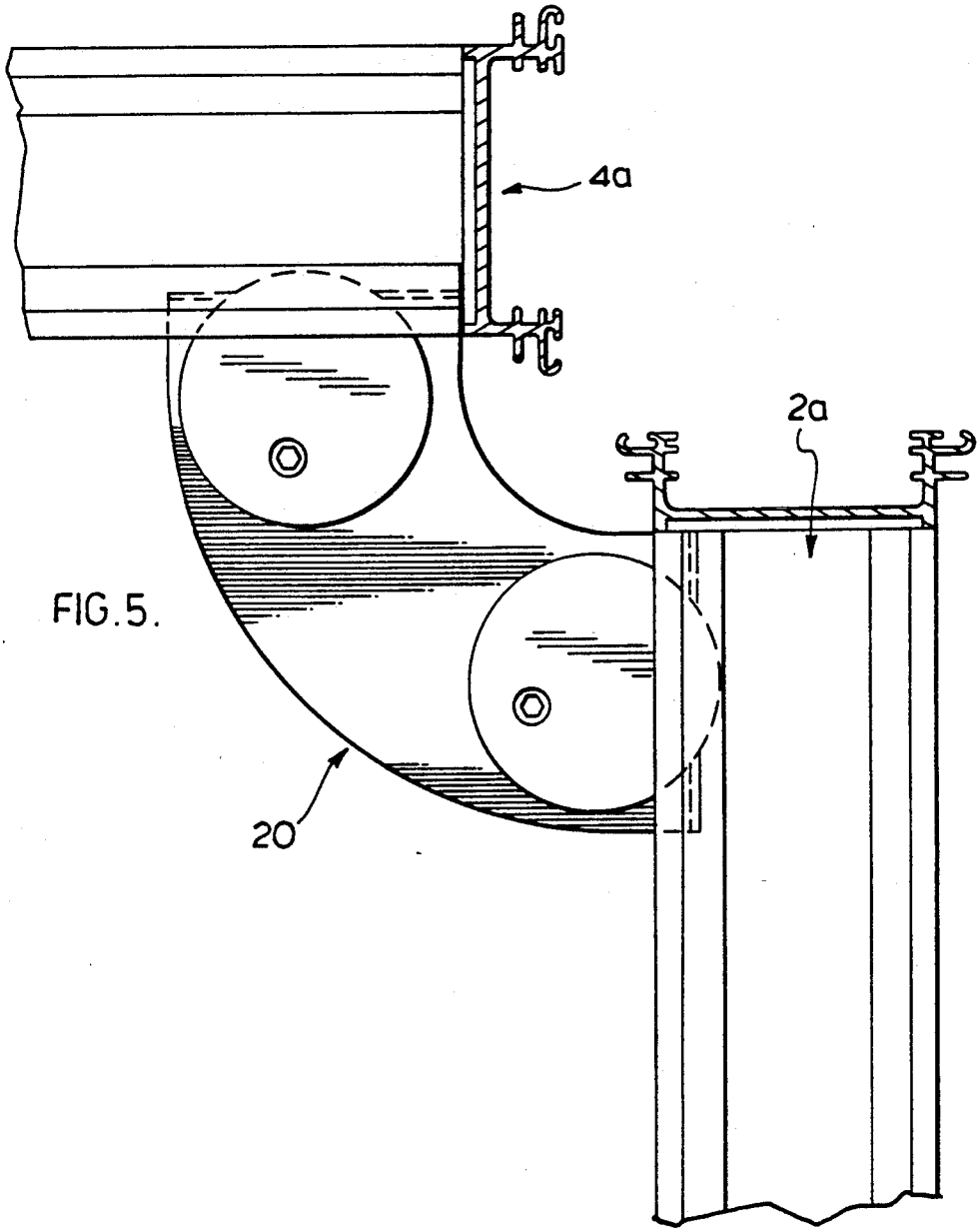
FIG. 5 is a top view showing one securing bracket engaging two panels and predetermining the angular orientation between the panels.
Figure 7:
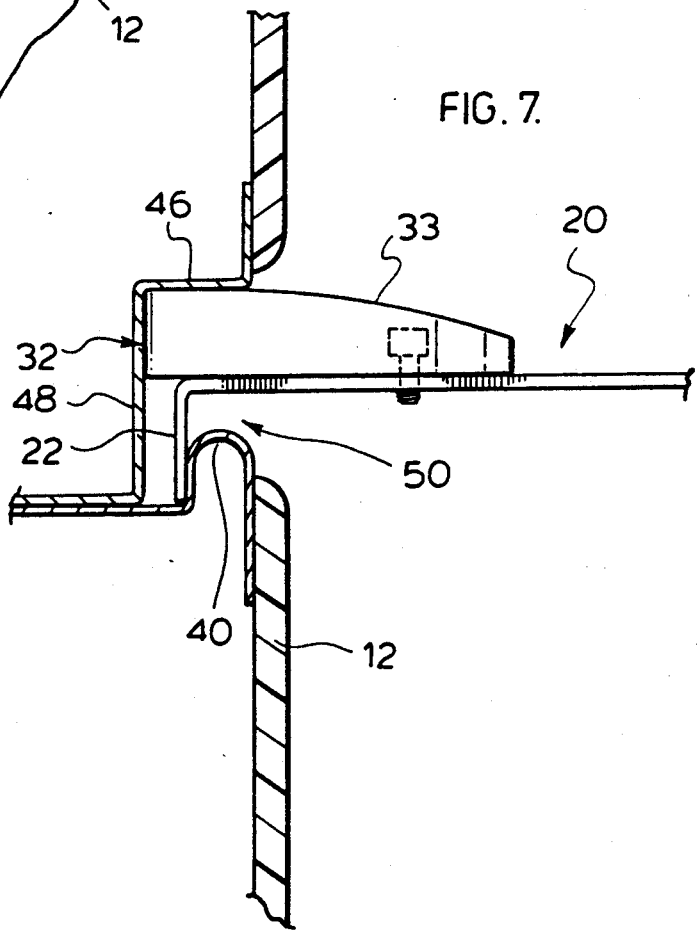
FIG. 7 is an elevational view showing a securing bracket engaging a slot of a panel.

Details of the securing bracket 20 and camming members used in association therewith are shown in FIGS. 3 through 5. The securing bracket 20 has downwardly extending flanges or tabs 22 adapted to engage and cooperate with a slot 8 of two separate panels. One of the flanges 22 engage one panel while the other flange engages a further panel. The downwardly extending flanges or tabs 22 are interconnected by a support plate 24. Preferably, the support plate and the flanges are formed as a single piece. A rotatable cam 26 is provided adjacent each extending flange 22 and is movable by means of a pivot action about the Allen screw 28 from a position which allows the bracket to easily be inserted in a slot of a panel to a position, generally indicated as 32 in FIG. 4, wherein a thick part of the cam has located itself over the respective extending flange 22 and has locked the respective flange in a slot 8 of a panel, as indicated in FIG. 7. It can be seen that the cam has a thick portion, generally shown as 34, and a thinner section 32 interconnected by a curved upper surface 33. This curved upper surface when the cam is engaging a slot preferably has full contact with the depth of the slot as indicated in FIG. 7. Once the securing bracket 20 has been brought into engagement with the respective panels 2*a* and 4*a* in FIG. 5, the cams 26 have been brought into an engaging position, with the thick portion 34 located in the slot and bearing against the top plate 46 of the slot, as shown in FIG. 7. This movement of the cam also serves to draw flange 22 into intimate contact with the back of the rail 40, as shown in FIG. 7.

Figure 6:
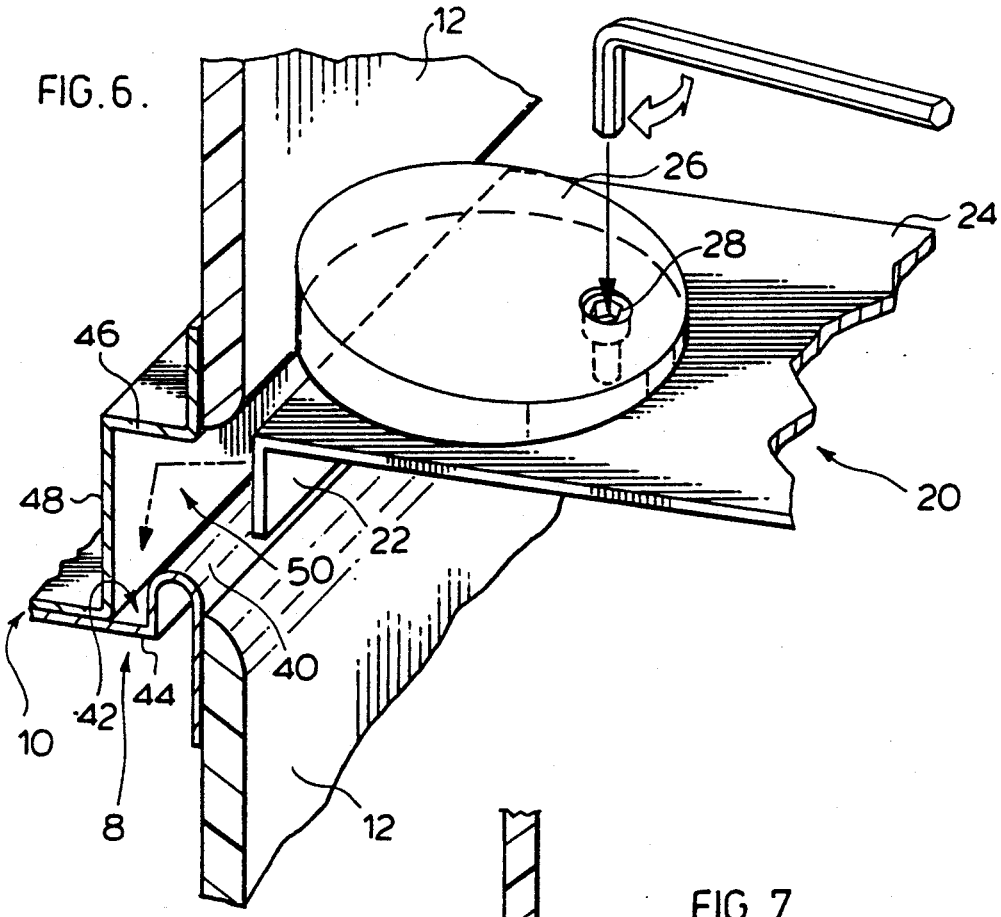
FIG. 6 is partial perspective view showing how an end of a bracket is inserted into a slot of the panel.

Details of one horizontal slot 8 is shown in FIG. 6 wherein the slot 8 is defined by a rail 40 having a recess 42 therebehind, with the slot preferably having a closed bottom 44, a closed top 46 and a closed back face or side 48. The slot is open at the front face 50. Although bottom 44, the top 46 and the back face 48 are closed, notched or punched areas could be present and possibly used for engaging the securing bracket 20, if so desired, or other components.

In order to secure bracket 20 to the slot 8 shown in FIG. 6, the bracket is brought into engagement with slot 8 by flange 22, passing over the rail 40 and then being moved downwardly such that the bottom of the flange 22 is in contact with the recess 42. This has been accomplished with the cam 26 moved to a non-operative position by pivotting of the cam away from the extending flange 22. Once the bracket has been located within the slot 8, i.e. with flange 22 in engagement with slot 8, the cam 26 may be moved to pass through the open portion of the slot and eventually move to a locked position, with the thick portion 34 of the cam being in engagement with the closed top 46 and with the cam also urging extending flange 22 into intimate contact with the back of the rail 40. This type of positioning can be predetermined by the manufacturing of the components, including the cam, and a locked position can be defined. The cam can provide a progressive lock surface to accommodate minor variations. This locked position can be maintained by tightening of the Allen screw 28. There are a host of arrangements for suitably maintaining the cam 26 in the locked type position shown in FIG. 7.

The securing bracket 20 can engage the slots 8 of two panels and thus fixedly secure the panels in a particular off module orientation. It can be appreciated that the support plate 24 can be shaped for different angles, such as 30°, 60°, 45°, 75°, etc., such that the bracket is suitable for many applications. In the panelling system of FIG. 1, two securing brackets 20 have been used to secure the second series of connected office panels 4 in a perpendicular orientation to the connected series of office panels 2 at a position in the series of connected office panels 2 intermediate the length of one panel. Thus, it is possible to make the connection at nonend locations of panels, adding additional flexibility to the planner and to allow rearrangement of the panels for future situations. The securing bracket is used for off module junctions whereas traditional securing is used where the ends of the panels meet a junction.

This bracket 20 has been specifically described with respect to fixing one panel at a predetermined orientation relative to another panel by means of a bracket engaging respective horizontal slots. It is also possible to use these horizontal slots 8 and the securing bracket 20 for securing of other equipment, such as a light, generally shown as 60 in FIG. 1. Therefore, this securing arrangement need not secure two adjacent panels, but can be used for providing a fixed securement of a bracket or other components within the horizontal slot 8 at various spaced locations within the individual panels 6.

Panels can have varying heights and the use of spaced slots 8 as engaging locations simplifies securement. The system preferably has rails at fixed elevations, even if panels are stacked one atop the other as described in our U.S. Pat. No. 4,535,577. Decorative elements may enclose some slots to achieve a desired visual appeal. The first rail is typically about 6 inches above the lower edge of a base panel and a rail is preferably provided every 15 inches thereafter.

The panel frames 10 include a power supply entry port 19 within the 6 inch metal base of the frame. These entry ports are used to provide a power connection 21 (armored cable) between the panels connected off module. This allows full powering of panels on the off module arm of the panelling system.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In an office panelling system having a multiplicity of interconnected panels joined end to end with other panels joined at an angle to the panels joined end to end, said panels having cover members supported by interior frames with each frame having horizontal securing rail members at common specified locations from the base of each panel, the improvement comprising positively securing an end of one of said panels intermediate the length of and at an angle to another one of said panels by means of a releasable securing arrangement, said securing arrangement engaging corresponding rails of each panel and fixedly securing said panels, said releasable securing arrangement capable of engaging any rail of a panel at any of a multiplicity of locations along the length of the rail.

2. In an office panelling system as claimed in claim 1 wherein said securing arrangement fixedly secures said panels at a predetermined angular orientation.

3. In an office panelling system as claimed in claim 2 wherein said securing arrangement is a fixed bracket having opposite end flanges engaged in respective slots of the joined panels.

4. In an office panelling system as claimed in claim 3 wherein said securing arrangement includes locking members which cooperate with a slot of a panel and lock said bracket to the respective slot.

5. In an office panelling system as claimed in claim 4 wherein said locking member is a movable cam which is movable from a locked position fixing said bracket to a slot to a non fixed position allowing the respective flange to be placed in a slot.

6. In an office panelling system as claimed in claim 5 wherein each slot is closed on one side and said cam member engages both the top and closed side of said slot.

7. In an office panelling system as claimed in claim 6 wherein said slot has a lower rail behind which said downwardly extending end flange is located.

8. In an office panelling system as claimed in claim 1 wherein said frames cooperate to define horizontal rails at about 6 inches above said base and intervals of 15 inches thereafter.

9. A securing arrangement for engaging the frame of an office panel comprising a first engaging member for receipt in a horizontal slot of the office panel and a movable cam member for movement form a position accommodating placement of said first engaging member in said slot to a position cooperating with said slot to fixedly locate said first engaging member relative to said slot and wherein said first engaging member has a downwardly extending end flange which is received behind said slot and said cam member is of variable thickness which cooperates with said slot in a wedging manner for fixedly securing said first member in said slot.

10. A securing arrangement as claimed in claim 9 wherein said slot is open on one side and closed at the top and bottom with said cam engaging and forming said wedging action in cooperation with said top.

11. A securing arrangement as claimed in claim 10 wherein said slot is closed on one side and has a lower rail upturn for engaging said downwardly extending flange, and wherein said cam member engages both the top and closed side of said slot and forces said downwardly extending flange into pressure contact with said lower rail upturn.

12. A securing arrangement as claimed in claim 11 wherein said securing arrangement has two ends with said first member and said cam member being located at one end of said securing arrangement, a corresponding first member and camming member located at the other end of said securing arrangement.

13. A securing arrangement as claimed in claim 12 wherein each cam member is a disk type member.

* * * * *